United States Patent [19]

Seitz et al.

[11] Patent Number: 4,465,387

[45] Date of Patent: Aug. 14, 1984

[54] DAISY WHEEL MOUNTING APPARATUS

[75] Inventors: Alan F. Seitz, New Hartford; Karl G. Seitz, Goshen, both of Conn.

[73] Assignee: Data Motion, Inc., Torrington, Conn.

[21] Appl. No.: 429,161

[22] Filed: Sep. 30, 1982

[51] Int. Cl.[3] ..... B41J 1/30

[52] U.S. Cl. ..... 400/175; 400/144.2

[58] Field of Search ..... 400/144.2, 175; 403/71, 403/192, 242, 261, 326, 361, 375, 381

[56] References Cited

U.S. PATENT DOCUMENTS

| | | | |
|---|---|---|---|
| 3,121,583 | 2/1964 | Damm | 403/326 |
| 3,391,773 | 7/1968 | Nicole et al. | 400/134.5 |
| 3,878,929 | 4/1975 | Orlens et al. | 400/175 |
| 3,954,163 | 5/1976 | Gabor | 400/144.2 |
| 4,060,162 | 11/1977 | Frechette | 400/144.2 |
| 4,074,798 | 2/1978 | Berger | 400/144.3 |
| 4,093,059 | 6/1978 | Sohl | 400/144.2 |
| 4,105,341 | 8/1978 | Chivens et al. | 400/144.2 |
| 4,118,129 | 10/1978 | Grundherr | 400/144.2 |
| 4,124,312 | 11/1978 | Johnson | 400/144.2 |
| 4,124,930 | 11/1978 | Bauer | 400/144.2 |
| 4,127,335 | 11/1978 | Bogert et al. | 400/144.2 |
| 4,127,336 | 11/1978 | Hiraoka et al. | 400/144.2 |
| 4,161,373 | 7/1979 | Chvatlinsky | 400/175 |
| 4,165,189 | 8/1979 | Bauer | 400/144.2 |
| 4,178,107 | 12/1979 | Guerrini et al. | 400/144.2 |
| 4,236,842 | 12/1980 | Dick et al. | 400/144.2 |
| 4,264,221 | 4/1981 | Habich et al. | 400/144.2 |
| 4,264,222 | 4/1981 | Bauer | 400/144.2 |
| 4,278,357 | 7/1981 | Matla et al. | 400/144.2 |
| 4,403,876 | 9/1983 | Vought | 400/144.2 |

FOREIGN PATENT DOCUMENTS 59681 4/1912 Switzerland .

OTHER PUBLICATIONS

Snap—On Coupling between Daisy Print Wheel and Drive Shaft"; P. Feinstein, Jr.; *IBM Technical Disclosure Bulletin;* vol. 23, No. 10, pp. 4810–4811; Mar. 1981.

*Primary Examiner*—Edgar S. Burr
*Assistant Examiner*—David A. Wiecking

[57] ABSTRACT

An integrally formed molded print wheel of the daisy wheel type for mounting on an arbor assembly of a printer includes a generally cylindrical hub and a generally annular support disc at one end of the hub and of larger dimension. A multiplicity of webs connect the hub to the support disc, and a multiplicity of flexible character arms extend radially from the support disc with each arm having an indicium adjacent its outer end for printing. A multiplicity of rib elements are integrally formed in the central passage of the hub and have a tapered portion to detachably secure the print wheel on the arbor of the printer.

7 Claims, 6 Drawing Figures

DAISY WHEEL MOUNTING APPARATUS

BACKGROUND OF THE INVENTION

This invention relates to a print wheel of the daisy wheel type adapted for mounting in a printer, and more particularly to an integrally formed synthetic resin print wheel.

In prior print wheels, the support disc and the connected flexible character arms are commonly made of synthetic resin, metal, or a combination thereof. The central hub or cap portion of the print wheel is generally comprised at least in part of a rubbery resin or thermoplastic resin to frictionally grip the arbor spindle, while allowing facile removal for interchange of print wheels. Such a rubber hub or cap of this type is shown in the print wheel of U.S. Pat. No. 4,060,621 to Frechette and necessarily requires manufacturing operations directed to the separate molding of the rubber hub and the bonding of the hub to the support disc in addition to the molding of the disc and character arms.

Further, it is necessary in print wheels of this type that the diameter of the central passageway in the hub be held to close tolerances. To obtain a diameter within acceptable tolerances, it is generally necessary to machine the print wheel after the molding process, and this machining operation is not only costly but also may introduce problems related to shrinkage and deformation of the plastic from breaking the skin of the molded article. The myriad drawbacks of machining the molded piece and prior attempts to achieve acceptable diameter tolerance without machining are discussed in U.S. Pat. No. 4,264,222 to Bauer wherein a metal ring is disposed in the central passageway of the hub during the molding process to achieve controlled tolerances. However, this method requires an additional metal element, i.e., the metal ring, in addition to the plastic disc and the rubber hub.

It is an object of the present invention to provide a novel print wheel of the daisy wheel type that is integrally formed of synthetic resin.

It is also an object to provide such a print wheel having a hub providing a central passageway within desired diametrical tolerances as molded.

Another object is to provide such a print wheel wherein a multiplicity of spaced ribs are integrally formed in the central passageway of the hub to frictionally engage the spindle of an associated printer arbor assembly and permit facile interchange.

Yet another object is to provide such a print wheel that is economical to manufacture, durable and convenient in use, and refined in appearance.

SUMMARY OF THE INVENTION

It is now been found that the foregoing and related objects and advantages can be readily attained in a print wheel of the daisy type which is integrally formed of synthetic resin and includes a generally cylindrical hub and a generally annular support disc about one end of the hub. The support disc has an inner diameter greater than the outer diameter of the hub so as to define a space therebetween and a multiplicity of webs in spaced disposition extend between the support disc and hub to secure the disc and hub in assembly. A multiplicity of flexible character arms extend radially outwardly from the outer periphery of the support disc about the entire circumference thereof, and each has an indicium formed thereon adjacent its outer end. The inner surface of the hub has a multiplicity of spaced ribs thereon extending inwardly to define a circle of lesser diameter than the major inner diameter of the hub, which ribs are adapted to frictionally engage the spindle of the associated arbor assembly.

In a preferred embodiment of the print wheel, the disc and webs are disposed adjacent one axial end of the hub and the ribs extend over only a portion of the axial length of the hub. Further, the ribs have a portion tapering to a greater depth adjacent one end to provide a circle of still smaller diameter. Desirably, the ribs on said hub are disposed substantially between the webs, and they extend from adjacent the axial end spaced from the disc and terminate adjacent the imaginary plane defined by the adjacent surface of the disc.

In the preferred embodiment, the hub has a multiplicity of radially outwardly extending fingers at the end thereof opposite from the disc to provide a finger gripping surface for inserting and removing the wheel from the printer arbor. These fingers desirably intersect at the center of the hub.

DETAILED DESCRIPTION OF THE ILLUSTRATED EMBODIMENT

Figure 1:
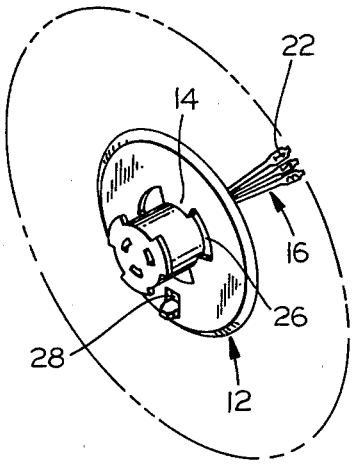
FIG. 1 is a perspective view of a print wheel embodying the present invention with the character arms partially diagramatically indicated and with the locating finger of the printer hub shown extending therethrough.

In the attached drawings, there is illustrated a print wheel of the daisy wheel type comprising a generally cylindrical hub generally designated by the numeral 10, an annular support disc generally designated by the numeral 12, a multiplicity of webs 14 interconnecting the hub 10 and disc 12, a multiplicity of character arms generally designated by the numeral 16 extending radially outwardly from the support disc 12. The print wheel is integrally formed from synthetic resin to produce a unitary structure.

As shown in FIG. 1, a multiplicity of character arms 16 extend radially outward from the outer periphery of the support disc 12 and each has a distinct indicium 22 formed on its outer end portion. These arms 16 are resiliently deflectible so that these outer ends may be moved from their static plane during impact printing.

Figure 2:
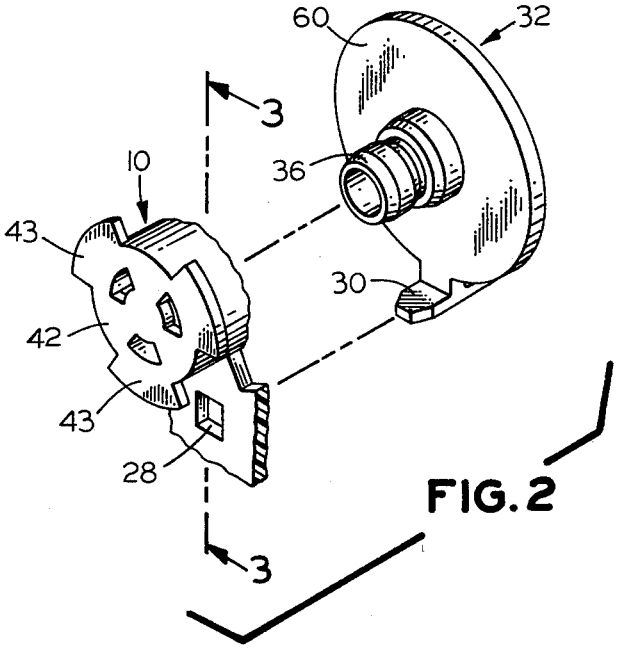
FIG. 2 is a fragmentary exploded view of the hub of FIG. 1 and the associated arbor of a printing machine drawn to an enlarged scale.
Figure 4:
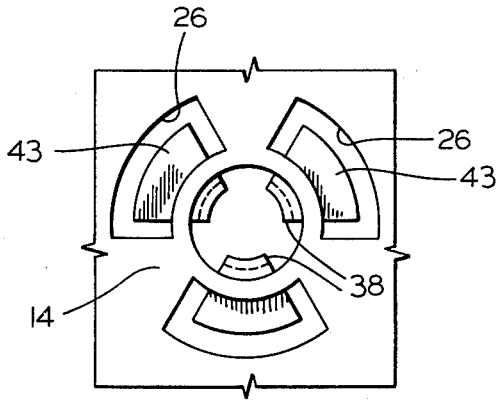
FIG. 4 is an enlarged fragmentary plan view of the surface of the hub opposite that seen in FIG. 1.

The support disc 12 has an inner circumference which is greater in diameter than the outer diameter of hub 10 so that a space 26 is provided between the hub 10 and the disc 12. As shown in FIG. 4, these equidistantly spaced webs 14 extend between the disc 12 and the hub 10 to secure them in assembly, and each web 14 is tapered to a reduced width at the hub 10. The support disc 12 also has a slot or aperture 28 therein which snugly receives the tab or locating finger 30 of an arbor assembly generally designated by the numeral 32 and best seen in FIG. 2. The seating of tab 30 into slot 28 serves to align the print wheel with respect to the printer. Further, during rotation the rotation of tab 30 serves to drive the print wheel in order to position the desired indicium 22 for impacting upon the ribbon (not shown) and paper being printed (not shown).

Figure 3:
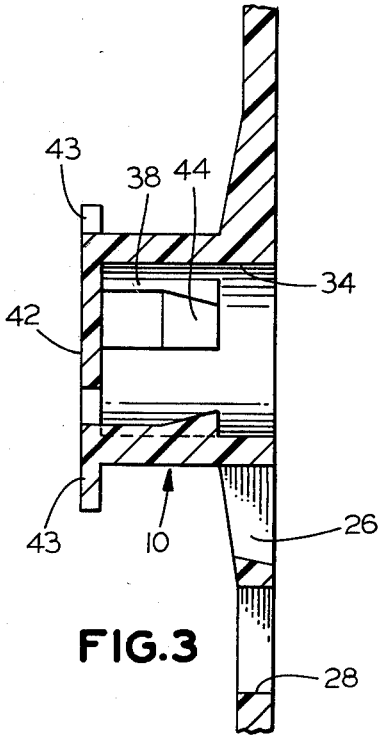
FIG. 3 is an enlarged sectional view of the wheel along the line 3—3 of FIG. 2.

The hub 10 is of generally cylindrical configuration and extends axially above the plane of disc 12 as seen in FIG. 3. The end 42 of hub 10 spaced from the disc 12 has a multiplicity of radially extending fingers 43 which intersect at the center of hub 10 and extend outwardly therefrom to provide a finger gripping surface for removal and mounting of the print wheel from the arbor assembly.

The inner surface 34 of hub 10 defines the central passage to receive the shaft or spindle 36 of the arbor assembly 32, and ribs 38 are integrally formed on the inner surface 34 of the hub 10 in spaced disposition between the webs 14 as seen in FIG. 4. Each rib 38 extends from adjacent the outer end, i.e., the end of hub 10 opposite that in the plane of the disc 12 and along a portion of the axial length of the hub 10 to terminate adjacent the imaginary plane defined by the support disc 12. These ribs 38 define a circle of smaller diameter than that defined by their root surface. Moreover, each rib 38 has a tapered portion 44 which extends radially inwardly towards the outer end to define a circle of still smaller diameter than that of the root surface of the hub 10. The angle of taper is preferably 15 degrees although an acceptable range of angles includes 10 degrees to 25 degrees.

Figure 6:
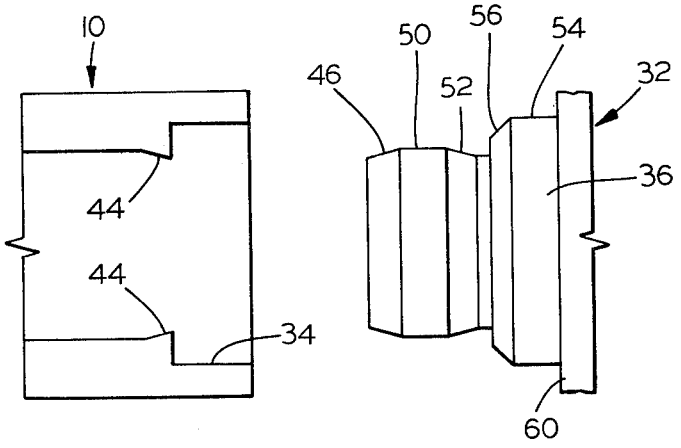
FIG. 6 is an exploded fragmentary view of the elements in FIG. 5.

The rib elements 38 are adapted to retentively engage the spindle 36 of the arbor assembly 32. As seen in FIG. 6, the outer circumference of the spindle 36 has a first collar portion 50 adjacent its outer end and a larger diameter collar portion 54 at its root adjacent the disc portion 60 of the arbor assembly 32. The collar portion 50 has an outer surface 46 and an inner surface 52 which taper from its large diameter body portion to a reduced diameter. The inner collar portion 54 also has a tapered surface 56 extending towards the first collar portion 50.

Figure 5:
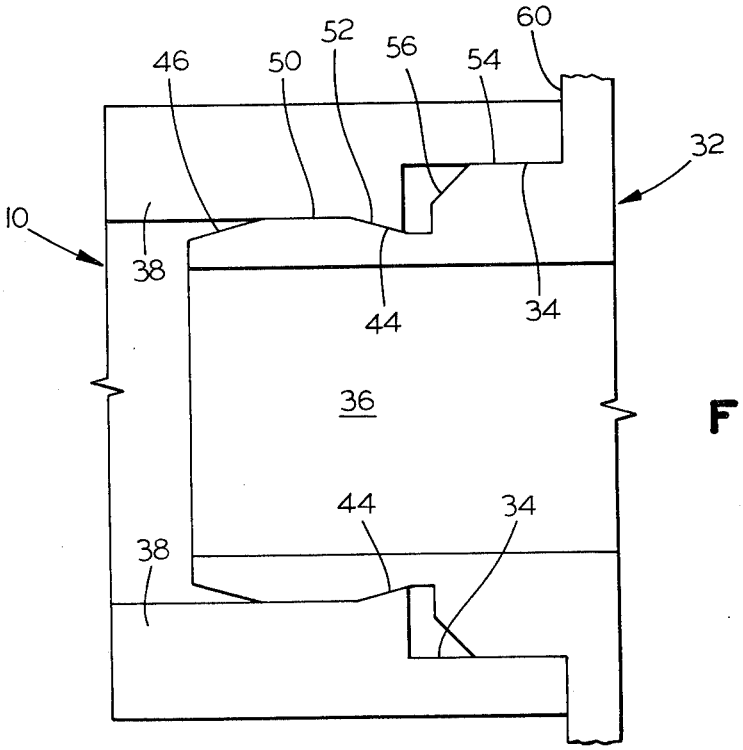
FIG. 5 is a greatly enlarged fragmentary sectional view diagramatically illustrating the mounting of the hub on the spindle of the associated arbor assembly.

In inserting the spindle 36 into the hub 10, the tapered outer surface 46 within the small diameter recess defined by rib elements 38 serves to center the spindle 36 within the central passage of the hub 10. The tab 30 is placed in alignment with the slot 28, and the spindle 36 is then fully inserted into hub 10 as seen in FIG. 5. In the fully inserted position of FIG. 5, the end of the hub 10 abuts the disc 60 of the arbor assembly 32, and the tapered portion 44 of each rib 38 frictionally engages the tapered surface 52 of spindle 36. Since the diameter of the body of the collar portion 50 is greater than the diameter defined by the tapered portion of the rib elements 38, force is necessary to resiliently expand and mount the hub 10 on the spindle 36. In this manner, the print wheel is detachably secured on the arbor assembly 32 without the necessity for a separate element to provide the desired frictional assembly.

The entire print wheel is integrally formed from a synthetic resin material providing good dimensional stability and wear resistance. Glass or carbon filled nylon has proven highly satisfactory. Exemplary is a nylon containing 30 percent by volume glass fibers sold by Liquid Nitrogen Processing of Malverne, PA under the designation RF-1006. The disposition and thickness of the ribs 38 in the hub 10 can be controlled to close tolerances to provide a precise concentric passageway for reception of the arbor spindle without the necessity for additional machining with its attendant adverse consequences upon the characteristics of the molded plastic print wheel structure.

Thus, it can be seen from the foregoing detailed specification and drawings that the present invention provides a novel print wheel that is integrally formed to provide a hub with close tolerances for frictional egagement of the arbor spindle. Moreover, the wheel is economical to manufacture and durable in use.

We claim:

1. An integrally formed, one piece synthetic resin print wheel of the daisy wheel type adapted for mounting upon the arbor assembly of a printer, said print wheel having a generally cylindrical hub having axially spaced ends and inner and outer surfaces of generally circular cross section;

a generally annular support disc about one of said axial ends of said hub and having an inner surface with an inner diameter greater than the diameter of said outer surface of said one end of said hub to define a generally annular space therebetween;

a multiplicity of spaced webs disposed in said generally annular space and extending radially inwardly between the inner surface of said annular disc to the outer surface of said hub to secure in assembly said support disc and said hub; and a multiplicity of flexible character arms extending radially outwardly from the outer periphery of said support disc and about the entire circumference thereof, said character arms having indicia formed thereon adjacent the outer ends thereof; the inner surface of said hub having a multiplicity of spaced ribs thereon extending inwardly thereof and defining a circle of lesser diameter than the inner diameter of said hub, said ribs being disposed on the inner surface of said hub in a circumferentially spaced relationship from said webs on said outer surface, said ribs thereby being adapted to frictionally engage the shaft of the associated arbor assembly.

2. The print wheel in accordance with claim 1 wherein said ribs extend over only a portion of the axial length of said hub.

3. The print wheel in accordance with claim 2 wherein said ribs taper radially inwardly from adjacent said other axial end toward said one axial end to define a circle of still smaller diameter adjacent said one axial end thereof.

4. The print wheel in accordance with claim 1 wherein said disc and said webs are disposed adjacent one axial end of said hub and wherein said ribs extend axially from adjacent the other end of said hub and terminate adjacent the imaginary plane defined by said disc.

5. The print wheel in accordance with claim 4 wherein said ribs taper radially inwardly from adjacent said other axial end toward said one axial end to define a circle of still smaller diameter adjacent said one axial end thereof.

6. The print wheel in accordance with claim 1 wherein said hub includes a multiplicity of fingers on the other of said axial ends extending radially outwardly therefrom to provide a finger gripping surface.

7. The print wheel in accordance with claim 1 wherein said webs taper to a reduced width at said hub.

* * * * *